US009978485B2

(12) United States Patent
Wang et al.

(10) Patent No.: US 9,978,485 B2
(45) Date of Patent: May 22, 2018

(54) NON-CONTACT LINEAR POTENTIOMETER

(71) Applicant: MultiDimension Technology Co., Ltd., Zhangjiagang (CN)

(72) Inventors: Feng Wang, Zhangjiagang (CN); Junyun Wang, Zhangjiagang (CN); Xiaochun Ji, Zhangjiagang (CN)

(73) Assignee: MultiDimension Technology Co., Ltd., Zhangjiagang (CN)

( * ) Notice: Subject to any disclaimer, the term of this patent is extended or adjusted under 35 U.S.C. 154(b) by 155 days.

(21) Appl. No.: 15/106,127

(22) PCT Filed: Dec. 17, 2014

(86) PCT No.: PCT/CN2014/094064
§ 371 (c)(1),
(2) Date: Jun. 17, 2016

(87) PCT Pub. No.: WO2015/090198
PCT Pub. Date: Jun. 25, 2015

(65) Prior Publication Data

US 2018/0053585 A1 Feb. 22, 2018

(30) Foreign Application Priority Data

Dec. 18, 2013 (CN) ..... 2013 1 0698204

(51) Int. Cl.
*H01C 10/30* (2006.01)
*H01C 10/14* (2006.01)

(52) U.S. Cl.
CPC ..... *H01C 10/14* (2013.01); *H01C 10/30* (2013.01)

(58) Field of Classification Search
CPC ..... H01C 10/14; H01C 10/30
(Continued)

(56) References Cited

U.S. PATENT DOCUMENTS 4,088,977 A * 5/1978 Bowman, Jr. ..... G01D 5/2241 336/110
4,771,240 A * 9/1988 Meyer ..... G01D 5/147 324/207.21
(Continued)

FOREIGN PATENT DOCUMENTS

CN 201010528601 5/2012
CN 202487305 10/2012
(Continued)

OTHER PUBLICATIONS

"International Application No. PCT/CN2014/094064, International Search Report and Written Opinion dated Mar. 3, 2015", (Mar. 3, 2015), 10 pgs.

*Primary Examiner* — Kyung Lee
(74) *Attorney, Agent, or Firm* — Schwegman Lundberg & Woessner, P.A.

(57) ABSTRACT

This invention discloses a type of noncontact linear potentiometer; the potentiometer comprises a slider, a rotating shaft, a guide rod, a tunneling magnetoresistive sensor, a permanent magnet, a printed circuit board, and two support structures. In this configuration the slider moves along the guide rod and the rotating shaft, causing the rotation of the rotating shaft; the permanent magnet is attached to an end of the rotating shaft, and it therefore rotates as the shaft rotates. A tunneling magnetoresistive sensor is located adjacent to the permanent magnet, soldered onto a printed circuit board, and it is used to measure the angle of rotation of the permanent magnet. The guide rod constrains the sliding direction of the slider, and the two support structures are located at the opposite ends of the guide rod and rotating shaft, and they are used to support the rotating shaft and guide rod. Located between the slider and rotating shaft is a ball bearing, a pin and a leaf spring assembly. This potentiometer has several advantages, including a compact struc-
(Continued)

ture, easy fabrication, long service life, in addition to providing smooth slider motion that provides a pleasing user experience.

15 Claims, 3 Drawing Sheets

(58) Field of Classification Search
USPC ..... 338/160
See application file for complete search history.

(56) References Cited

U.S. PATENT DOCUMENTS

| | | | | | |
|---|---|---|---|---|---|
| 5,087,879 | A * | 2/1992 | Sugifune | G01B 7/14 | 29/595 |
| 6,133,730 | A * | 10/2000 | Winn | G01P 1/00 | 324/173 |
| 6,154,025 | A * | 11/2000 | Schelter | B82Y 25/00 | 324/174 |
| 6,600,314 | B2 * | 7/2003 | Kou | B82Y 25/00 | 324/247 |
| 6,879,240 | B2 * | 4/2005 | Kruse | B60G 7/005 | 338/12 |

FOREIGN PATENT DOCUMENTS

| | | |
|---|---|---|
| CN | 203260444 | 10/2013 |
| CN | 103646736 | 3/2014 |
| CN | 203659562 | 6/2014 |
| DE | 4109658 | 9/1992 |
| WO | WO-2015090198 | 6/2015 |

* cited by examiner

NON-CONTACT LINEAR POTENTIOMETER

PRIORITY CLAIM TO RELATED APPLICATIONS

This application is a U.S. national stage application filed under 35 U.S.C. § 371 from International Application Serial No. PCT/CN2014/094064, which was filed 17 Dec. 2014, and published as WO2015/090198 on 25 Jun. 2015, and which claims priority to Chinese Application No. 201310698204.2, filed 18 Dec. 2013, which applications and publication are incorporated by reference as if reproduced herein and made a part hereof in their entirety, and the benefit of priority of each of which is claimed herein.

FIELD OF THE INVENTION

The present invention relates to a linear potentiometer, in particular to a noncontact linear potentiometer which converts a linear displacement into a rotational angular displacement and performs detection through a tunneling magnetoresistive sensor.

BACKGROUND OF THE INVENTION

This potentiometer is a new type of electronic component, having high linearity, high reliability, and the like, and it can be applied to fields such as aviation, spaceflight, precision instruments and meters, and the like. With the development of technology, a potentiometer with long-service-life, high-performance and high-reliability is urgently needed. At present, there has been great progress on rotary potentiometers. There is however little research on linear sliding potentiometers.

In the prior art, a linear sliding type potentiometer uses an electronic brush structure to achieve the function of the product by changing the position of the electronic brush by means of linear sliding. Chinese patent application 201010528601.1 titled "linear sliding type potentiometer" discloses a linear sliding type potentiometer, which comprises a housing, a sliding shaft capable of moving in the housing and an output bus installed on the housing, wherein a resistor assembly is installed in the housing, and the resistor assembly comprises an insulating board provided with a conductive tracks and three installation wires installed on the insulating board. One end of the sliding shaft projects into an interior of the housing, and an electronic brush assembly is installed at the end of the sliding shaft which projects into the housing, the electronic brush assembly comprises a slider fixed on the sliding shaft, a spring leaf connected with the electronic brush is fixed on the slider, and the electronic brush is in contact with the conductive track on the insulating board. Although the sensor can convert linear displacement to an electric signal, the structure thereof is complex, the service life is short and thus the sensor is not suitable for frequent slider motion. On the basis of this design, the applicant makes some improvements to the structure and proposes a new patent application 201220557883.2, this patent application discloses a coaxial duplex linear sliding type potentiometer. The potentiometer comprises a housing, a conductive plastic substrate I and a conductive plastic substrate II, wherein a lower surface of the conductive plastic substrate I and an upper surface of the conductive plastic substrate II are respectively provided with a resistor, a sliding rod projecting out of the housing between the conductive plastic substrate I and the conductive plastic substrate II, a slider is provided at the end of the sliding rod which projects into the housing, and upper and lower side surfaces of the slider that respectively are provided with two electronic brushes. Voltage signals output by the potentiometer have a linear relationship with linear displacements of an adjusting shaft, and conversion from mechanical movement to electric signals can be realized. Although the reliability thereof is improved relative to the former one, the structure thereof is more complex, the cost is also higher and the service life is not long enough.

SUMMARY OF THE INVENTION

The purpose of the present invention is to overcome the above-mentioned defects in the prior art and provide a noncontact linear potentiometer with ultra-long service life. The potentiometer is compact in structure and simple in fabrication, and can convert linear movement into rotation and realize detection of a rotating angle using a noncontact tunneling magnetoresistive sensor, in order to obtain the improvement of the service life.

In order to realize the above-mentioned purpose, the present invention is implemented by adopting the following technical solution:

The present invention provides a noncontact linear potentiometer. The noncontact linear potentiometer comprises a slider, a rotating shaft, a tunneling magnetoresistive sensor, a permanent magnet and support structures; the slider is provided with a first through hole;

the rotating shaft penetrates through the first through hole and the two ends of the rotating shaft are rotatably installed on the support structures;

the slider slides along an axial direction of the rotating shaft, and the sliding of the slider drives the rotating shaft to rotate;

the permanent magnet is located at one end of the rotating shaft and rotates with the rotating shaft; and the tunneling magnetoresistive sensor is located adjacent to the permanent magnet and is used for detecting a magnetic field produced by the rotating permanent magnet and converting the detected magnetic field into a voltage signal for output.

Preferably, the noncontact linear potentiometer further comprises a guide rod, and the slider is further provided with a second through hole; and the guide rod penetrates through the second through hole and is in parallel with the rotating shaft, and two ends of the guide rod are fixed on the support structures.

Preferably, the tunneling magnetoresistive sensor is a biaxial rotary magnetic sensor or two orthogonal uniaxial rotary magnetic sensors.

Preferably, the permanent magnet is disc-shaped, annular or square.

Preferably, the tunneling magnetoresistive sensor is a biaxial linear magnetic sensor.

Preferably, the permanent magnet is disc-shaped or annular.

Preferably, a central axis of the tunneling magnetoresistive sensor and central axes of the permanent magnet and the rotating shaft are the same.

Preferably, an internal magnetizing direction of the permanent magnet is perpendicular to the axial direction of the rotating shaft.

Preferably, the noncontact linear potentiometer further comprises a ball bearing which is located between the slider and the rotating shaft.

Preferably, a pin used for withstanding the ball bearing is assembled between the slider and the rotating shaft, and the pin can slide along a direction in parallel with a plane formed by the rotating shaft and the guide rod and perpendicular to the axial direction of the rotating shaft.

Preferably, a spring leaf is assembled between the slider and the pin.

Preferably, the rotating shaft thereon comprises a spiral groove along which the ball bearing rolls.

Preferably, a spiral thread on a lead screw is rolled by using a thread rolling plate and a desired surface hardness on the lead screw is obtained by adopting an electroplating process or a heat treatment process.

Preferably, a bottom of the noncontact linear potentiometer is provided with a printed circuit board which further comprises wiring pins thereon, and the tunneling magnetoresistive sensor is soldered on the printed circuit board.

Preferably, the rotating shaft is a lead screw or a torsion rod.

The principle of the screw rod is reversely applied, and the slider is used as a power source to drive the rotating shaft to rotate, so as to convert linear movement into circular movement. The ball bearing, the pin and the spring leaf are assembled between the slider and the rotating shaft. In addition, a guide rod is used for providing sliding guide of the slider. The role of the ball bearing is to convert sliding friction into rolling friction, such that the friction force is minimized. The spring leaf and the slidable pin are used for eliminating a gap caused by fabrication error and assembling, so as to guarantee the accuracy of forward and backward travels.

Compared with the prior art, the present invention has the following beneficial effects:

1) the structure of the present invention is simple, the fabrication is easy and the cost is low;

2) since the linear sliding displacement is converted into the rotational angular displacement and the rotating angle of the rotating shaft is sensed through the tunneling magnetoresistive sensor in the present invention, the linearity thereof is improved and the power consumption is also reduced;

3) the tunneling magnetoresistive sensor in the present invention can realize the measurement without being in contact with the rotating shaft, and thus the service life is improved; and 4) since the slider only needs to be manually operated to slide along the rotating shaft and the guide rod in the present invention, the operation is simple and easy to realize.

DESCRIPTION OF THE DRAWINGS

In order to more clearly illustrate the technical solution in the embodiments of the present invention, the drawings which need to be used in the description of the embodiments will be simply introduced below. Obviously, the drawings described below are just some embodiments of the present invention. For one skilled in the art, other drawings can be obtained according to these drawings without contributing any inventive labor.

DETAILED DESCRIPTION OF THE EMBODIMENTS

Figure 1:
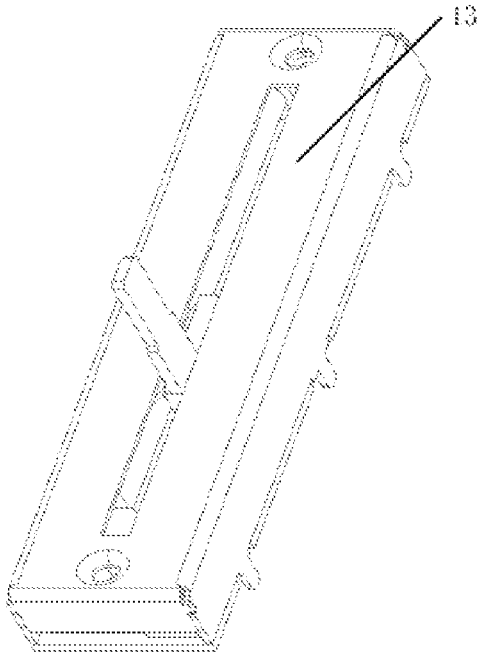
FIG. 1 is a schematic diagram of an external structure of a noncontact linear potentiometer in the present invention.

The present invention will be illustrated below in detail by referring to the drawings in combination with the embodiments.

EMBODIMENTS

Figure 2:
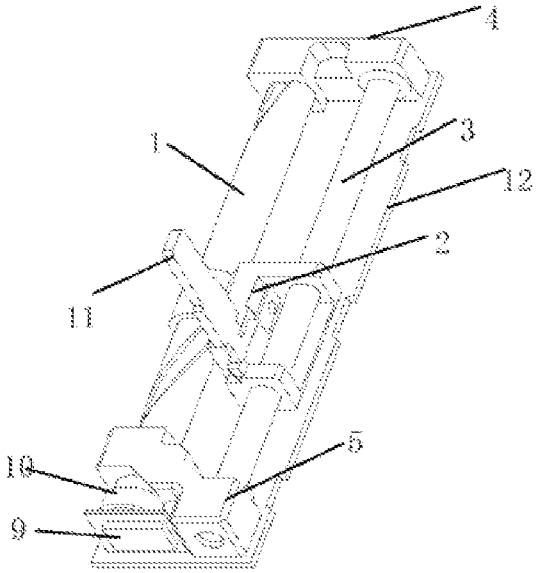
FIG. 2 is a schematic diagram of an internal structure of a noncontact linear potentiometer in the present invention.
Figure 3:
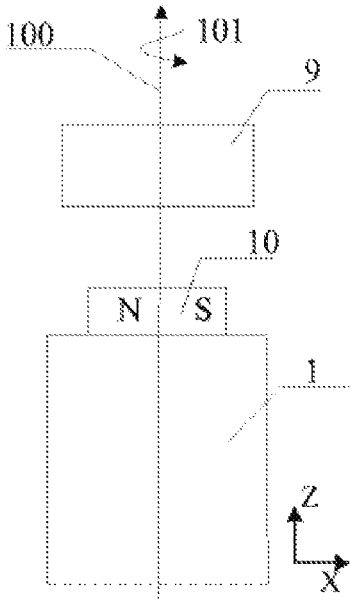
FIG. 3 is a sectional schematic diagram of a position relationship between a tunneling magnetoresistive sensor and a permanent magnet.

FIG. 1 is a schematic diagram of an external structure of a noncontact linear potentiometer in the present invention. FIG. 2 is a schematic diagram of an internal structure of the potentiometer after removing a housing 13. The potentiometer comprises a rotatable rotating shaft 1, a slider 2, a fixed guide rod 3, support structures 4 and 5, a tunneling magnetoresistive (TMR) sensor 9, a permanent magnet 10 and a printed circuit board 12. In the specific embodiments of the present invention, the rotating shaft 1 thereon is provided with a spiral protrusion or groove which can convert sliding of the slider into rotation of the rotating shaft. In this embodiment, the rotating shaft 1 is a lead screw. The lead screw 1 penetrates through a corresponding first through hole in the slider 2, two ends of the lead screw 1 are rotatably installed onto the support structures 4 and 5, one end of the guide rod 3 is fixed on the support structure 4, and the other end penetrates through a corresponding second through hole in the slider 2 and is fixed onto the support structure 5. In this embodiment, the guide rod 3 is in parallel with the lead screw 1. By moving a handle 11 on the slider 2, the slider 2 can be caused to slide along an axial direction of the lead screw 1 and the guide rod 3 (i.e., a Z-axis direction 100 in FIG. 3), so as to drive the lead screw 1 to rotate. The permanent magnet 10 is located at one end of the lead screw 1 and also rotates with the lead screw 1. The tunneling magnetoresistive sensor 9 is located adjacent to the permanent magnet 10 and is soldered on the Printed Circuit Board (PCB) 12, as shown in FIG. 2, and the printed circuit board 12 is located at a bottom of the potentiometer and further comprises wiring pins (not shown) thereon. The tunneling magnetoresistive sensor 9 can be a biaxial rotary magnetic sensor or two orthogonal uniaxial rotary magnetic sensors, in this case, the permanent magnet 10 can be disc-shaped, annular or square, and a central axis of the tunneling magnetoresistive sensor 9 and central axes of the permanent magnet 10 and the lead screw 1 are the same. The tunneling magnetoresistive sensor 9 can also be a biaxial linear magnetic sensor, in this case, the permanent magnet 10 can be disc-shaped or annular, and the tunneling magnetoresistive sensor 9 is located around the permanent magnet 10, and preferably is placed coaxial with the permanent magnet 10. An internal magnetizing direction of the permanent magnet 10 is as shown by an N pole and an S pole in FIG. 3, from which it can be seen that the magnetizing direction is perpendicular to the Z-axis direction 100.

It needs to be stated that the above-mentioned guide rod 3 is a preferred mode and is used for providing sliding guide of the slider 2.

Figure 4:
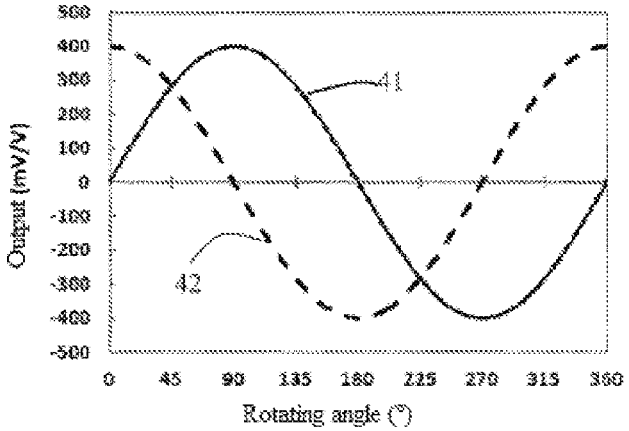
FIG. 4 is a curve chart of a relationship between output voltage of a noncontact linear potentiometer and a rotating angle of a permanent magnet in the present invention.

When the permanent magnet 10 rotates with the lead screw 1 along a rotating direction 101, curves of changes in magnetic field components in X-axis and Y-axis which are detected by the tunneling magnetoresistive sensor 9 with rotating angles are as shown by curves 41 and 42 in FIG. 4.

The tunneling magnetoresistive sensor 9 converts the amplitude of the magnetic field produced by the permanent magnet 10 into an analog voltage signal, and the obtained analog voltage signal can be directly output and can also be output after being converted into a digital signal by using an analog-to-digital converter (ADC) circuit. The rotating angle of the permanent magnet 10, i.e., the rotating angle of the lead screw 1 can be known according to the output signal.

Figure 5:
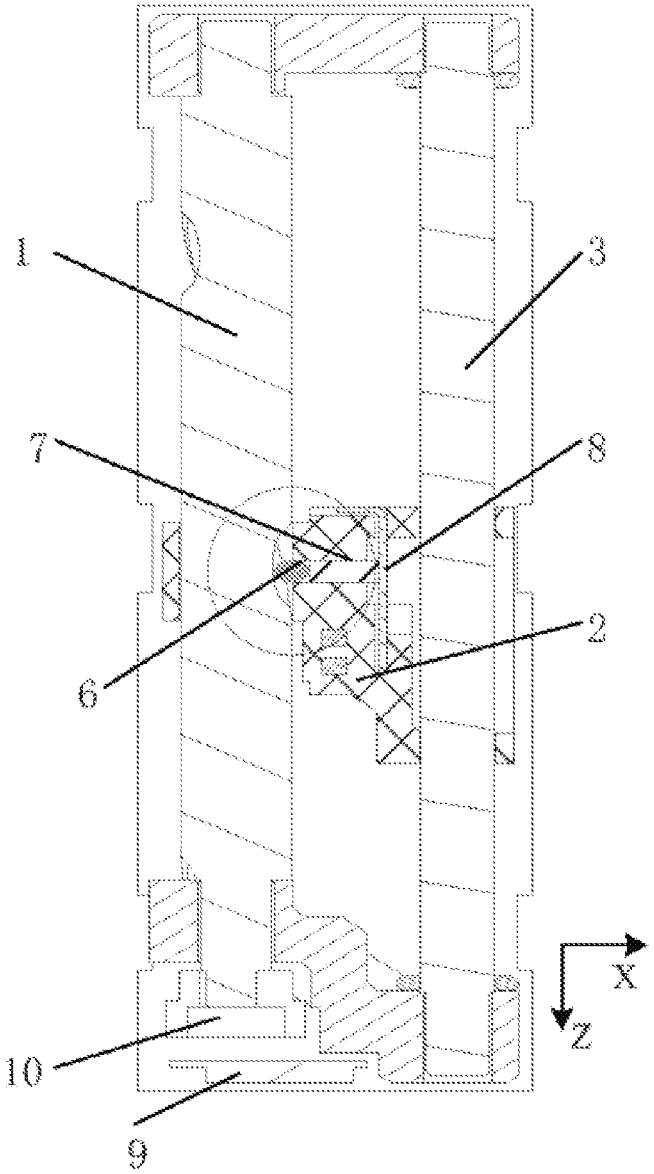
FIG. 5 is a local sectional view of a noncontact linear potentiometer in the present invention.

A ball bearing 6, a pin 7 and a spring leaf 8 are assembled between the slider 2 and the lead screw 1, as shown in FIG. 5. The ball bearing 6 rolls along the spiral groove on the lead screw 1 and the role thereof is to convert sliding friction into rolling friction to minimize the friction force, so as to prolong the service life. The pin 7 is used for withstanding the ball bearing 6 and can slide along a direction in parallel with a plane formed by the rotating shaft and the guide rod and perpendicular to the axial direction of the rotating shaft, i.e., along an X-axis direction, and the spring leaf 8 and the pin 7 are used for eliminating a gap caused by fabrication error and assembling, so as to guarantee the accuracy of forward and backward travels. The above-mentioned X-axis direction is a direction in parallel with the plane formed by the rotating shaft and the guide rod and perpendicular to the axial direction of the rotating shaft.

Figure 6:
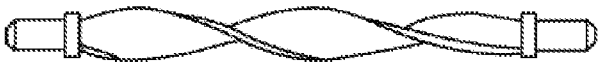
FIG. 6 is a structural schematic diagram of a torsion rod replacing a lead screw.

The lead screw 1 is improved by adopting a thread rolling process, a spiral thread needed for travel guide is rolled by using a thread rolling plate, and the slider 2 can slide along the spiral thread. In order to improve the service life, a desired surface hardness can be obtained by adopting a common electroplating process or heat treatment process, so as to reduce the wear and prolong the service life. Moreover, the lead screw 1 can also be replaced with a torsion rod, a structure of which is as shown in FIG. 6. A material for fabricating the torsion rod is relatively cheap, the fabrication process is also simpler and thus the cost is reduced. Other parts are all fabricated by adopting common fabrication processes and are easy to implement.

The above-mentioned embodiments are just preferred embodiments of the present invention and are not used for limiting the present invention. For one skilled in the art, various alterations and variations may be made to the present invention. Any modification, equivalent replacement, improvement and the like made within the spirit and principle of the present invention shall also be included in the protection range of the present invention.

The invention claimed is:

1. A noncontact linear potentiometer, the noncontact linear potentiometer comprising:

a slider, a rotating shaft, a tunneling magnetoresistive sensor, a permanent magnet, and support structures;

wherein the slider is provided with a first through hole;

wherein the rotating shaft penetrates through the first through hole and the two ends of the rotating shaft are rotatably installed on the support structures;

wherein the slider slides along an axial direction of the rotating shaft, and the sliding of the slider drives the rotating shaft to rotate;

wherein the permanent magnet is located at one end of the rotating shaft and rotates with the rotating shaft; and wherein the tunneling magnetoresistive sensor is located adjacent to the permanent magnet and is used for detecting a magnetic field produced by the rotation of the permanent magnet and converting the detected magnetic field into a voltage signal for output.

2. The noncontact linear potentiometer according to claim 1, wherein the noncontact linear potentiometer further comprises a guide rod, and the slider is further provided with a second through hole; and wherein the guide rod penetrates through the second through hole and is in parallel with the rotating shaft, and two ends of the guide rod are fixed on the support structures.

3. The noncontact linear potentiometer according to claim 2, wherein the noncontact linear potentiometer further comprises a ball bearing which is located between the slider and the rotating shaft.

4. The noncontact linear potentiometer according to claim 3, wherein a pin used for withstanding the ball bearing is assembled between the slider and the rotating shaft, and the pin can slide along a direction in parallel with a plane formed by the rotating shaft and the guide rod and perpendicular to the axial direction of the rotating shaft.

5. The noncontact linear potentiometer according to claim 4, wherein a spring leaf is assembled between the slider and the pin.

6. The noncontact linear potentiometer according to claim 3, wherein the rotating shaft thereon comprises a spiral groove along which the ball bearing rolls.

7. The noncontact linear potentiometer according to claim 1, wherein the tunneling magnetoresistive sensor is a biaxial rotary magnetic sensor or two orthogonal uniaxial rotary magnetic sensors.

8. The noncontact linear potentiometer according to claim 7, wherein the permanent magnet is disc-shaped, annular or square.

9. The noncontact linear potentiometer according to claim 1, wherein the tunneling magnetoresistive sensor is a biaxial linear magnetic sensor.

10. The noncontact linear potentiometer according to claim 9, wherein the permanent magnet is disc-shaped or annular.

11. The noncontact linear potentiometer according to claim 1, wherein a central axis of the tunneling magnetoresistive sensor and central axes of the permanent magnet and the rotating shaft are the same.

12. The noncontact linear potentiometer according to claim 1, wherein an internal magnetizing direction of the permanent magnet is perpendicular to the axial direction of the rotating shaft.

13. The noncontact linear potentiometer according to claim 1, wherein a bottom of the noncontact linear potentiometer is provided with a printed circuit board which further comprises wiring pins thereon, and the tunneling magnetoresistive sensor is soldered on the printed circuit board.

14. The noncontact linear potentiometer according to claim 1, wherein the rotating shaft is a lead screw or a torsion rod.

15. The noncontact linear potentiometer according to claim 14, wherein a spiral thread on the lead screw is rolled by using a thread rolling plate and a desired surface hardness on the lead screw is obtained by adopting an electroplating process or a heat treatment process.

* * * * *